US009260826B2

(12) United States Patent
Donelson

(10) Patent No.: US 9,260,826 B2
(45) Date of Patent: Feb. 16, 2016

(54) SURFACING SYSTEM AND METHOD

(71) Applicant: Donelson Construction Co., LLC, Clever, MO (US)

(72) Inventor: Michael James Donelson, Springfield, MO (US)

(73) Assignee: Donelson Construction Co., LLC, Clever, MO (US)

( * ) Notice: Subject to any disclaimer, the term of this patent is extended or adjusted under 35 U.S.C. 154(b) by 0 days.

(21) Appl. No.: 14/271,236

(22) Filed: May 6, 2014

(65) Prior Publication Data

US 2015/0322632 A1 Nov. 12, 2015

(51) Int. Cl.

| | |
|---|---|
| ***E01C 19/00*** | (2006.01) |
| ***E01C 19/16*** | (2006.01) |
| ***E01C 19/12*** | (2006.01) |
| ***E01C 23/14*** | (2006.01) |
| ***E01C 23/06*** | (2006.01) |

(52) U.S. Cl.

CPC ..... *E01C 19/16* (2013.01); *E01C 19/12* (2013.01); *E01C 23/06* (2013.01); *E01C 23/14* (2013.01); *E01C 2301/02* (2013.01)

(58) Field of Classification Search

CPC ..... E01C 19/12; E01C 19/16; E01C 23/06; E01C 23/14; E01C 2301/02

USPC ..... 404/75, 111

See application file for complete search history.

(56) References Cited

U.S. PATENT DOCUMENTS

| | | | | |
|---|---|---|---|---|
| 1,914,950 | A * | 6/1933 | Kanen | 404/111 |
| 3,153,992 | A * | 10/1964 | Dabelle | 404/111 |
| 3,206,174 | A * | 9/1965 | Young | 366/8 |
| 3,283,675 | A * | 11/1966 | Gifford et al. | 404/111 |
| 4,069,182 | A * | 1/1978 | McDonald | 521/44.5 |
| 4,364,690 | A | 12/1982 | Bruns | |
| 4,557,626 | A | 12/1985 | McKay et al. | |
| 4,917,533 | A | 4/1990 | Wilson | |
| 4,958,955 | A | 9/1990 | Laditka | |
| 5,251,998 | A * | 10/1993 | Laditka | 404/75 |
| 5,735,634 | A | 4/1998 | Ulrich et al. | |
| 6,102,615 | A * | 8/2000 | Wilson, Sr. | 404/111 |
| 7,033,106 | B2 | 4/2006 | Harvey | |
| 7,104,724 | B2 * | 9/2006 | Terry | 404/110 |
| 7,798,744 | B2 | 9/2010 | Larson et al. | |
| 7,802,941 | B2 | 9/2010 | Wingo et al. | |
| 8,113,736 | B2 * | 2/2012 | Wilson, Sr. | 404/72 |

FOREIGN PATENT DOCUMENTS

GB 2420144 A 5/2006

* cited by examiner

*Primary Examiner* — Raymond W Addie

(74) *Attorney, Agent, or Firm* — Armstrong Teasdale LLP

(57) ABSTRACT

A system for re-surfacing a pavement surface is provided. The system includes a material dispersal device configured to apply a slurry material to the pavement surface, a first delivery mechanism configured to apply a first spreadable material to the pavement surface, a first dispersing bar configured to disperse the first spreadable material on the pavement surface, a second delivery mechanism configured to apply a second spreadable material to the pavement surface, and a second dispersing bar configured to disperse the second spreadable material on the pavement surface.

38 Claims, 6 Drawing Sheets

SURFACING SYSTEM AND METHOD

BACKGROUND OF THE DISCLOSURE

The field of the disclosure relates generally to pavement re-surfacing and, more particularly, to a method and systems for re-surfacing a pavement surface using a material dispersal device (e.g., a surface smoothing box).

Many roadways and other paved surfaces exhibit surface wheel-rutting and general degradation over time. Re-surfacing is a solution which improves skid resistance and the overall quality of these surfaces by applying a uniform layer of a re-surfacing material to the surface. Typically, the layer of re-surfacing material is applied to the surface using a truck, or other mobile device, as it travels along the surface. The re-surfacing material may typically include a slurry material, emulsion oil, and/or an aggregate. The choice of material and method of application may vary depending at least on the project and any desired or necessary characteristics of the re-surfaced pavement.

At least some known systems for pavement re-surfacing use a spray system to apply the re-surfacing material. A spray system is capable of applying a uniform layer of re-surfacing material to the roadway. However, spray systems are susceptible to clogging. For example, a spray system for re-surfacing using a re-surfacing material including aggregate that is sufficiently large may result in clogging of the spray system. In this example, clogging may be lessened by using a re-surfacing material having smaller aggregate. However, this imposes a limit on at least the functionality of the roadway.

BRIEF DESCRIPTION OF THE DISCLOSURE

In one aspect, a system for re-surfacing a pavement surface is provided. The system includes a material dispersal device that includes a plurality of independent dispersing elements and a plurality of biasing elements. The material dispersal device also includes a plurality of independent dispersing assemblies, wherein each independent dispersing assembly of the plurality of independent dispersing assemblies includes at least one biasing element of the plurality of biasing elements coupled to at least one independent dispersing element of the plurality of independent dispersing elements.

In another aspect, a system for re-surfacing a pavement surface is provided. The system includes a material dispersal device that includes a frame, a first support member adjustably coupled to the frame, a second support member adjustably coupled to the frame, a plurality of independent dispersing elements, and a plurality of biasing elements. The material dispersal device also includes a plurality of independent dispersing assemblies, wherein each independent dispersing assembly includes at least one biasing element of the plurality of biasing elements coupled to at least one independent dispersing element of the plurality of independent dispersing elements. The material dispersal device further includes a primary dispersing device including at least one independent dispersing assembly of the plurality of independent dispersing assemblies coupled to the first support member. The material dispersal device also includes a secondary dispersing device including at least one independent dispersing assembly of the plurality of independent dispersing assemblies coupled to the second support member. The system also includes a delivery mechanism configured to apply a spreadable material to the pavement surface and a dispersing bar configured to disperse the spreadable material on the pavement surface.

In yet another aspect, a method for re-surfacing a pavement surface is provided. The method includes applying a first spreadable material to the pavement surface using a first delivery mechanism. The method also includes dispersing the first spreadable material on the pavement surface using a first dispersing bar configured to apply substantially uniform pressure across the pavement surface.

DETAILED DESCRIPTION OF THE DISCLOSURE

Figure 1:
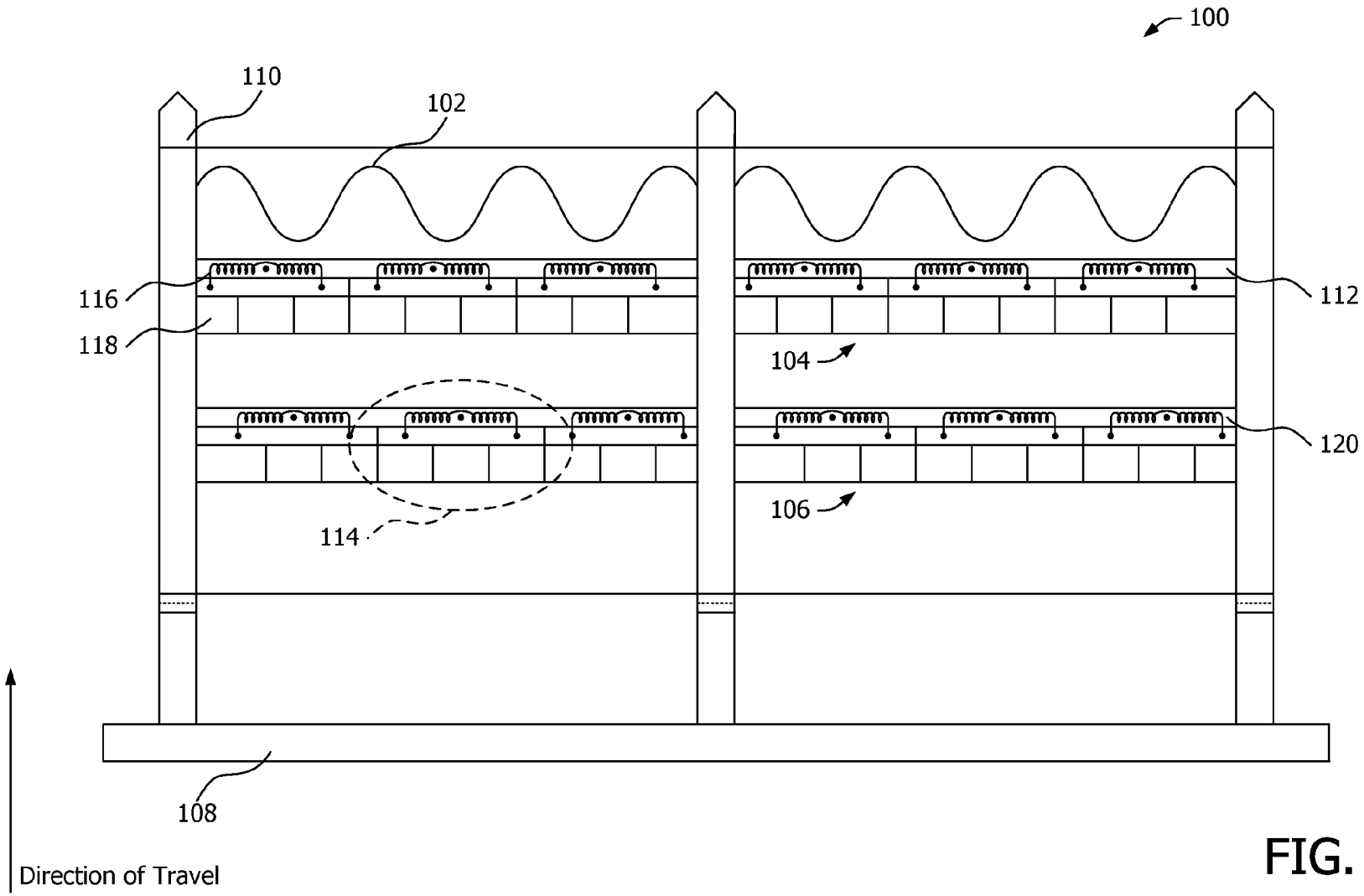
FIG. 1 is a schematic view of a material dispersal device.

FIG. 1 is a schematic view of a material dispersal device 100 in accordance with one embodiment of the disclosure. Material dispersal device 100 is configured to apply material (e.g., a slurry material, an emulsion oil, a micro-surfacing material, or other material) uniformly to a pavement surface by use of segmented, independently biased units. These units are segmented with sufficient frequency so they apply sufficient pressure to the material and allow uniform dispersion of the material when the pavement surface is uneven, e.g., when the pavement surface is a roadway with surface wheel-rutting.

In the exemplary embodiment, material dispersal device 100 includes a frame 110. An auger 102, a primary dispersing device 104, a secondary dispersing device 106, and a finishing bar 108 are coupled to frame 110. Auger 102 and finishing bar 108 are located at opposite ends of material dispersal device 100. Primary dispersing device 104 is located between auger 102 and finishing bar 108, and secondary dispersing device 106 is located between primary dispersing device 104 and finishing bar 108. In some embodiments, material dispersal device 100 is configured to smooth and/or texture a slurry material that is deposited external to device 100. For example, material dispersal device 100 may be configured without an auger and a finishing bar, and slurry material is applied to the pavement surface using a pump and spray system. A micro-surfacing layer may be fabricated by passing material dispersal device 100 over the applied slurry material.

During operation of material dispersal device 100 in accordance with the example embodiment, slurry material is deposited into material dispersal device 100 at auger 102, smoothed by primary dispersing device 104, further smoothed by secondary dispersing device 106, and texturized by finishing bar 108. More specifically, slurry material is deposited at auger 102 which disperses the slurry material the width of device 100. Primary dispersing device 104 sets the depth, or thickness, of the re-surfacing layer as it passes over the dispersed slurry material. Secondary dispersing device 106 functions similar to primary dispersing device 104 and is used to reduce the amount of slurry material that may be missed by primary dispersing device 104. The texture of the re-surfacing layer is set using finishing bar 108 which may be constructed similarly to either primary dispersing device 104 or secondary dispersing device 106, or may be a single structure (e.g., a squeegee).

Primary dispersing device 104 includes a first support member 112 and a plurality of independent dispersing assemblies 114. First support member 112 is adjustably coupled to frame 110 so that the contact pressure of primary dispersing device 104 on the pavement surface can be changed. Each independent dispersing assembly 114 includes a biasing element 116 coupled to one or more independent dispersing elements 118. Biasing elements 116 of the primary dispersing device 104 are further coupled to first support member 112 and allow each dispersing assembly 114 to move vertically and rotate. Each dispersing assembly 114 is a segmented unit that enhances the ability of device 100 to follow the contour of the pavement surface.

In the exemplary embodiment, each independent dispersing element 118 is either a brush or a blade (e.g., a squeegee). The type of element 118 is determined by the desired application characteristics. For example, a brush may be desirable when applying an emulsion oil to the pavement surface to facilitate urging the emulsion oil into voids, or cracks, in the pavement surface. Alternatively, a blade may be desirable when applying a slurry material to the pavement surface to facilitate application of a smooth and even layer of the slurry material due to its more rigid construction when compared to a brush.

Secondary dispersing device 106 includes a second support member 120 and a plurality of independent dispersing assemblies 114. Second support member 120 is adjustably coupled to frame 110 so that the contact pressure of secondary dispersing device 106 on the pavement surface can be changed. As previously described, each independent dispersing assembly 114 includes a biasing element 116 coupled to one or more independent dispersing elements 118. Biasing element 116 of each independent dispersing assembly 114 of secondary dispersing device 106 is further coupled to second support member 120 and allows each assembly 114 to move vertically and rotate.

In the exemplary embodiment, each independent dispersing assembly 114 of primary dispersing device 104 is offset with respect to each dispersing assembly 114 of secondary dispersing device 106. During operation, some material may not be fully distributed by primary dispersing device 104. For example, some material may pass through voids between the independent dispersing elements and/or voids between the independent dispersing assemblies. Offsetting secondary dispersing device 106 with respect to primary dispersing device 104 facilitates the dispersal of such material.

As described, material dispersal device 100 uniformly applies slurry material to a pavement surface. Independent dispersing assemblies 114 of primary dispersing device 104 and secondary dispersing device 106 are configured to move vertically and rotate so that each independent dispersing assembly 114 is allowed to follow the contour of the pavement surface. Additionally, the support members of primary dispersing device 104 and secondary dispersing device 106 are adjustably coupled to frame 110 of device 100 such that the contact pressure of each can be changed. Therefore, material dispersal device 100 is configurable to apply even contact pressure along the contour of the pavement surface to effect uniform application of slurry material to the pavement surface.

Figure 2:
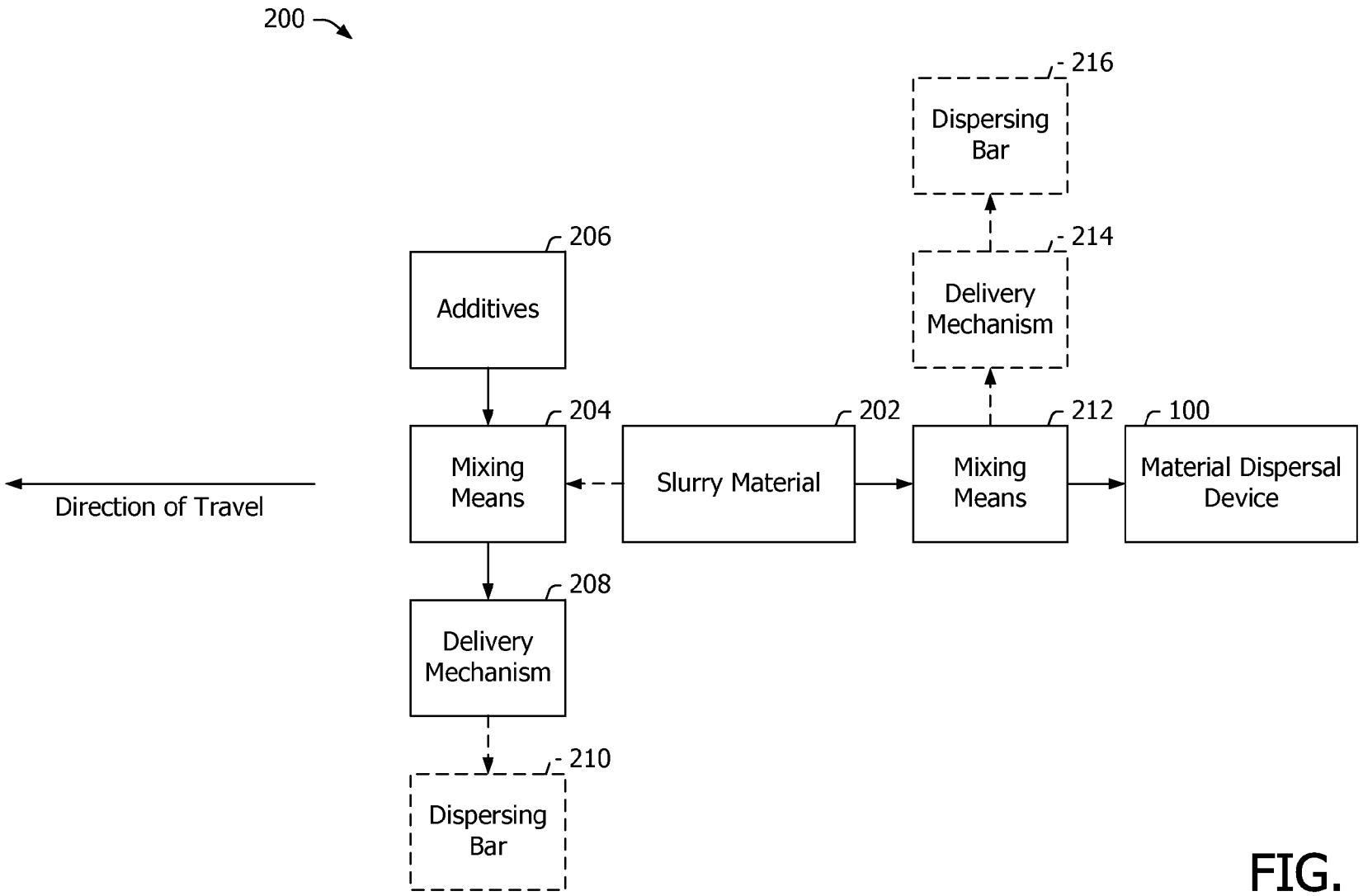
FIG. 2 is a block diagram of an exemplary system for re-surfacing a pavement surface including the material dispersal device shown in FIG. 1.

FIG. 2 is a block diagram of an exemplary system 200 for re-surfacing a pavement surface including a material dispersal device 100 (shown in FIG. 1). System 200 may be implemented using any mobile device suited for re-surfacing applications. For example, the mobile device may be a truck equipped with material storage facilities, pumps, plumbing, towing means, and other equipment which allow the mobile device to store, transport, disperse, and distribute material to micro-surface a pavement surface. During operation, material is applied as the mobile device moves across the pavement surface thereby re-surfacing the pavement surface.

To re-surface a pavement surface, a slurry material 202 is stored in a mobile device (not shown), e.g., in bulk tank storage of the mobile device. Slurry material 202 includes emulsified oil and aggregate. Slurry material 202 may further include one or more of emulsified asphalt, water, catalysts (e.g., Portland cement), chemicals to slow system break, fiber material, and other materials. In one embodiment, slurry material 202 is a micro-surfacing material and a micro-surface is created. In another embodiment, slurry material 202 is a seal coat. In yet another embodiment, slurry material 202 is an emulsion oil and is used to facilitate a crack sealing process. Slurry material 202 may be pre-mixed off site, compounded on the mobile device, or a combination of both.

At least some of slurry material 202 may be mixed 204 with additives 206 to improve ductility, adhesion, crack sealing, toughness, or other similar properties. Mixing 204 may be accomplished using any standard means, e.g., using line injection. The resulting mixture may be distributed on the paved surface using a delivery mechanism 208 (e.g., a spray bar). Delivery mechanism 208 includes one or more apertures or slits, and is configured to controllably apply material to the pavement surface. Delivery mechanism 208 may further be configured to produce a gravity flow or a pressurized flow. In some embodiments, delivery mechanism 208 is a component of the mobile device (or is coupled with the mobile device). In other embodiments, delivery mechanism 208 is a component of material dispersal device 100 (or is coupled with material dispersal device 100). In the example embodiment, delivery mechanism 208 is located between the mobile device and material dispersal device 100, and is a pump and spray system that facilitates application of the slurry material mixture to the pavement surface in a layer with substantially uniform thickness.

When pre-mixed off site and/or compounded on the mobile device, slurry material 202 is blended by the pump action of delivery mechanism 208. Once blended, slurry material 202 will begin to destabilize (or break) and eventually cure. The components of slurry material 202 affect how quickly material 202 will cure after destabilization begins. In one embodiment, delivery mechanism 208 agitates slurry material 202 (e.g., by the pumping action) to slow destabilization while material 202 is transported to the point of application.

In one embodiment, system 200 includes a dispersing bar 210 configured to disperse the slurry material mixture on the pavement surface. Dispersing bar 210 is a brush or blade system similar to primary dispersing device 104 or secondary dispersing device 106. In some embodiments, dispersing bar 210 is a component of the mobile device (or is coupled with the mobile device). In other embodiments, dispersing bar 210 is a component of material dispersal device 100 (or is coupled with material dispersal device 100). In the example embodiment, dispersing bar 210 is located between delivery mechanism 208 and material dispersal device 100. In an alternative embodiment, system 200 includes a thermal bias (not shown) located proximate dispersing bar 210. The thermal bias is used to induce heat to the slurry material mixture, e.g., to reduce the viscosity of the mixture such that it may be more easily urged into voids or cracks in the pavement surface.

In another aspect of system 200, slurry material 202 is mixed 212 then introduced into material dispersal device 100 to re-surface the pavement surface. In the example embodiment, the mobile device includes a pugmill, a pump and spray system, or other device for mixing 212 slurry material 202. The mobile device further includes standard equipment to transport slurry material 202 to material dispersal device 100. Slurry material 202, once mixed 212, is applied to the pavement surface by material dispersal device 100. As previously described, device 100 is configured to uniformly apply slurry material 202 to the pavement surface.

In one embodiment, some or all of slurry material 202 is distributed and dispersed on the pavement surface using a delivery mechanism 214 and a dispersing bar 216. Delivery mechanism 214 is configured to controllably apply slurry material 202 to the pavement surface and dispersing bar 216 is a brush or blade system configured to disperse slurry material 202 on the pavement surface in a layer having substantially uniform thickness.

In another embodiment, slurry material 202 includes a first slurry material, a fiber material, and a second slurry material. During operation, the first slurry material is mixed 204 and applied to the pavement surface, the fiber material is applied to the pavement surface, and the second slurry material is mixed 212 and applied to the pavement surface. In some embodiments, the fiber material is a single fiber material. In other embodiments, the fiber material is a composition including one or more different fiber materials, where each of the different fiber materials has unique size, shape, strength, texture, or other characteristics. For example, a first slurry material is applied to the pavement surface by a first delivery mechanism, a fiber material is applied to the pavement surface by a second delivery mechanism, and a second slurry material is applied to the pavement surface by a third delivery mechanism. In some embodiments, a re-surfaced pavement is created by passing a material dispersal device over the first slurry material, the fiber material, and the second slurry material. In other embodiments, a re-surfaced pavement is created by passing a dispersing bar over the materials, where the dispersing bar is configured to apply substantially uniform pressure across the pavement surface.

In yet another embodiment, slurry material 202 includes a first slurry material and a second slurry material, where the first slurry material and the second slurry material are different. During operation, the first slurry material is mixed 204 and applied to the pavement surface and the second slurry material is mixed 212 and introduced into material dispersal device 100 (or applied to the pavement surface). For example, a first slurry material is applied to the pavement surface by a first delivery mechanism and a second slurry material is applied to the pavement surface by a second delivery mechanism. In some embodiments, the first slurry material is dispersed on the pavement surface by a dispersing bar to facilitate crack filling (or crack sealing) by urging the first slurry material into cracks (or voids) in the pavement surface. In other embodiments, a re-surfaced pavement is created by passing a material dispersal device over the first slurry material and the second slurry material. In yet other embodiments, a re-surfaced pavement is created by passing a dispersing bar over the slurry materials, where the dispersing bar is configured to apply substantially uniform pressure across the pavement surface. In the previous example, the material dispersal device may or may not include an auger.

Figure 3:
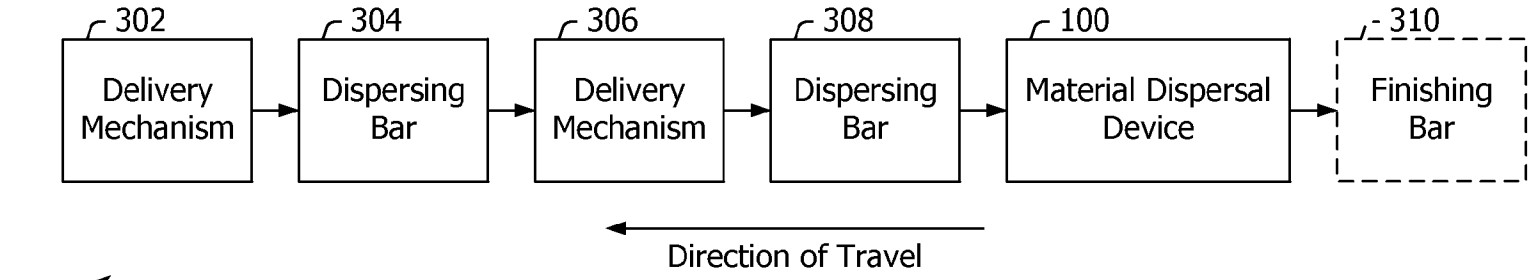
FIG. 3 is a block diagram of an exemplary system for re-surfacing a pavement surface similar to the system shown in FIG. 2.
Figure 4:
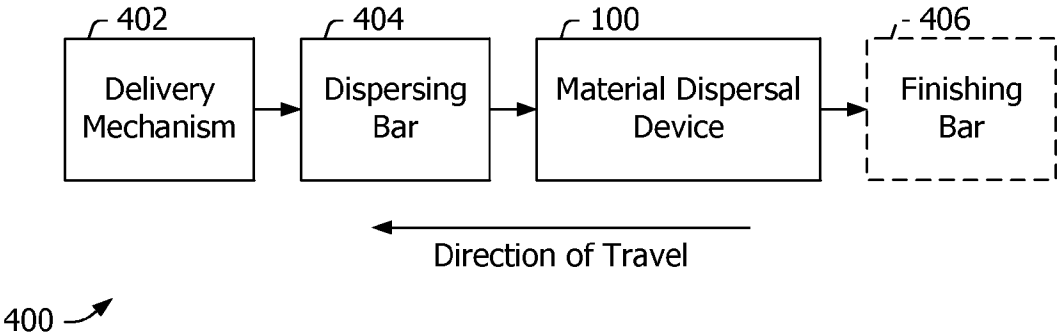
FIG. 4 is a block diagram of another exemplary system for re-surfacing a pavement surface similar to the system shown in FIG. 2.
Figure 5:
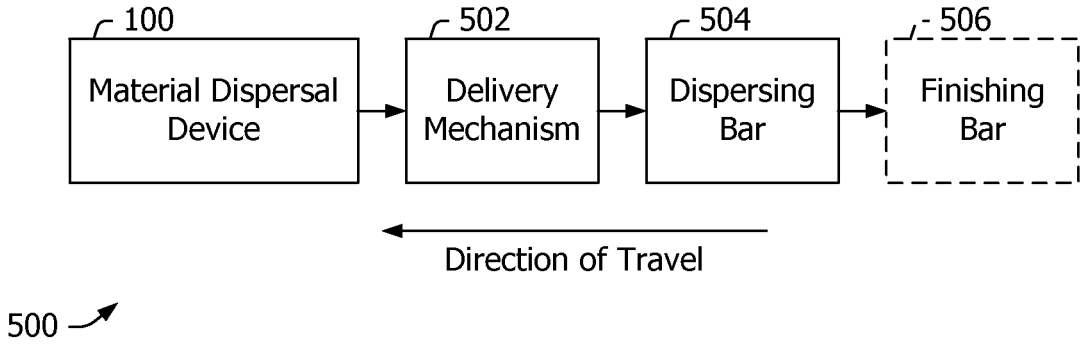
FIG. 5 is a block diagram of a further exemplary system for re-surfacing a pavement surface similar to the system shown in FIG. 2.

FIGS. 3 through 5 illustrate exemplary systems having some or all of the elements of system 200 shown in FIG. 2. These systems represent alternative embodiments of system 200 shown in FIG. 2 for re-surfacing a pavement surface. These systems may be implemented using any mobile device suited for re-surfacing applications. For example, the mobile device may be a truck equipped with material storage facilities, pumps, plumbing, towing means, and other equipment which allow the mobile device to store, transport, disperse, and distribute material to micro-surface a pavement surface. During operation, slurry material is applied as the mobile device moves across the pavement surface thereby re-surfacing the pavement surface.

FIG. 3 is a block diagram of an alternative system 300 for re-surfacing a pavement surface similar to system 200 shown in FIG. 2. System 300 includes a delivery mechanism 302, a dispersing bar 304, a material dispersal device 100, an additional delivery mechanism 306, an additional dispersing bar 308, and optionally includes a finishing bar 310. Delivery mechanism 302 applies a primer coating, a slurry, and/or other material to the pavement surface which is dispersed by dispersing bar 304. Additional material may be applied and dispersed by delivery mechanism 306 and dispersing bar 308. Slurry material is then applied to the pavement surface by material dispersal device 100. Finishing bar 310 is used to texture, or otherwise finish, the re-surfaced pavement.

FIG. 4 is a block diagram of another alternative system 400 for re-surfacing a pavement surface similar to system 200 shown in FIG. 2. System 400 includes a delivery mechanism 402, a dispersing bar 404, a material dispersal device 100, and optionally includes a finishing bar 406. Delivery mechanism 402 applies a primer coating, slurry material, and/or other material to the pavement surface which is dispersed by dispersing bar 404. Slurry material is then applied to the pavement surface by material dispersal device 100. Finishing bar 406 is used to texture, or otherwise finish, the re-surfaced pavement.

FIG. 5 is a block diagram of a further alternative system 500 for re-surfacing a pavement surface similar to system 200 shown in FIG. 2. System 500 includes a material dispersal device 100, a delivery mechanism 502, a dispersing bar 504, and optionally includes a finishing bar 506. Slurry material is applied to the pavement surface by material dispersal device 100. Additional material may be applied to the pavement surface by delivery mechanism 502 and dispersed by dispersing bar 504. Finishing bar 506 is used to texture, or otherwise finish, the re-surfaced pavement.

Figure 6:
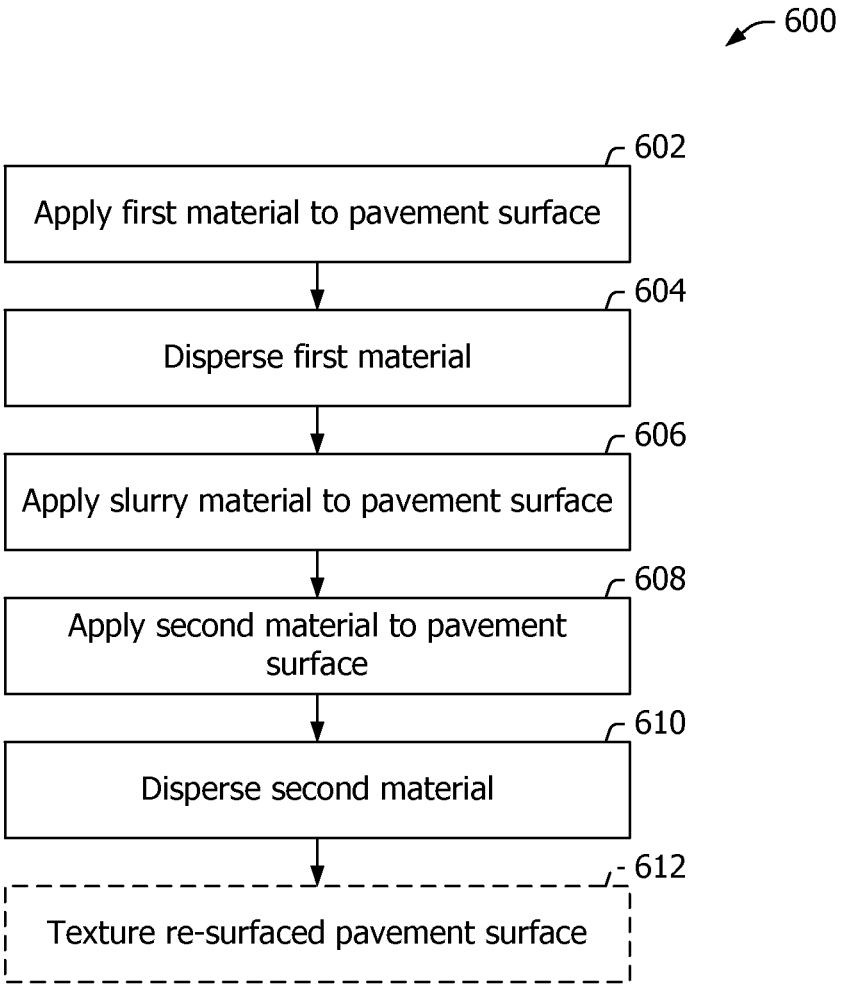
FIG. 6 is a flow diagram of an exemplary method for re-surfacing a pavement surface.

FIG. 6 is a flow diagram of an exemplary method 600 for re-surfacing a pavement surface. In the exemplary embodiment, method 600 is implemented by a re-surfacing system including a material dispersal device, such as system 200 shown in FIG. 2.

During operation, a first material is applied 602 to the pavement surface. The first material may be a primer coating, and/or other re-surfacing material such as an emulsion oil, slurry material, or aggregate. The first material is dispersed 604 on the pavement surface. In some embodiments, dispersing 604 the first material on the pavement surface facilitates a crack filling (or crack sealing) process by urging the first material into voids, or cracks, in the pavement surface. In other embodiments, dispersing 604 facilitates uniform spreading of the first material to allow a layering effect with subsequently applied materials.

Slurry material is applied 606 to the pavement surface using a material dispersal device, such as material dispersal device 100 shown in FIG. 1. The material dispersal device is configured to follow the contour of the pavement surface and apply 606 a uniform layer of material. The slurry material includes emulsified oil and aggregate. The slurry material may also include one or more of emulsified asphalt, water, catalysts (e.g., Portland cement), chemicals to slow system break, fiber material, and other materials. In some embodiments, the slurry material is an emulsion oil and is used to facilitate a crack sealing process.

A second material is applied 608 and dispersed 610 on the pavement surface. The second material may be an emulsion oil, slurry material, or aggregate. In some embodiments, the second material is used to coat or seal the re-surfaced pavement, or to achieve desired coloring of the re-surfaced pavement. Optionally, the re-surfaced pavement is textured 612 to achieve a surface texture of the re-surfaced pavement. For example, texturing may achieve a surface texture that provides an enhanced driving surface when the re-surfaced pavement is a roadway.

Figure 7:
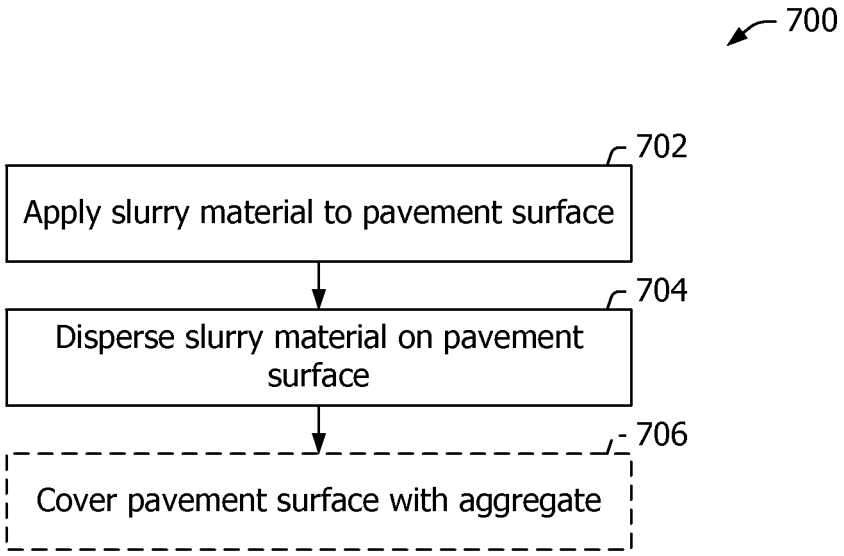
FIG. 7 is a flow diagram of another exemplary method for re-surfacing a pavement surface.

FIG. 7 is a flow diagram of another exemplary method 700 for re-surfacing a pavement surface. Method 700 may be implemented by any suitable re-surfacing system and may optionally be implemented by a system including a material dispersal device, such as system 200 shown in FIG. 2.

During operation, a slurry material is applied 702 to the pavement surface. The slurry material may be applied 702 using an auger, plumbing, or other means. Depending on the application or desired characteristics of the final re-surfaced pavement, the applied material may be a primer coating, a micro-surfacing material, or an emulsion oil.

The applied slurry material is then dispersed 704 on the pavement surface. Dispersing 704 the slurry material on the pavement surface facilitates crack filling (or crack sealing) by urging the material into voids, or cracks, in the pavement surface. Dispersing 704 the slurry material on the pavement surface also facilitates uniform spreading of the material to allow a layering effect with subsequently applied materials. In one embodiment, the slurry material is dispersed 704 using a dispersing bar, such as dispersing bar 210, 216 shown in FIG. 2. The dispersing bar is a brush, a blade, or other suitable device, and is configured to apply substantially uniform pressure across the pavement surface. In other embodiments, the slurry material may be dispersed 704 using a material dispersal device, such as device 100 shown in FIG. 1.

In an alternate embodiment, the pavement surface is covered 706 by an aggregate. The aggregate at least partially combines with material applied to the pavement surface. For example, the aggregate may at least partially settle, draw, or be urged into the applied slurry material on the pavement surface. The aggregate used to cover 706 the pavement surface is chosen based on the application or desired characteristics of the final re-surfaced pavement. In some embodiments, the aggregate is a single aggregate. In other embodiments, the aggregate is a composition including one or more different aggregates, where each of the different aggregates has a unique size, shape, texture, or other characteristics.

Figure 8:
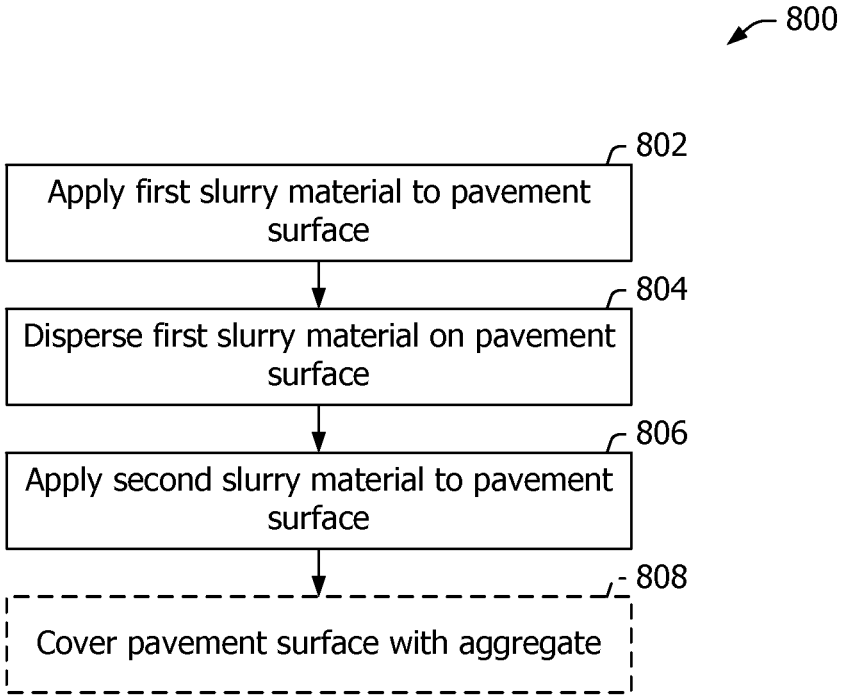
FIG. 8 is a flow diagram of a further exemplary method for re-surfacing a pavement surface similar to the method of FIG. 7.

FIG. 8 is a flow diagram of a further exemplary method 800 for re-surfacing a pavement surface, similar to method 700 shown in FIG. 7. Method 800 may be implemented by any suitable re-surfacing system and may optionally be implemented by a system including a material dispersal device, such as system 200 shown in FIG. 2.

During operation, a first slurry material is applied 802 to the pavement surface. The first slurry material is applied 802 using an auger, plumbing, or other means. Depending on the application or desired characteristics of the final re-surfaced pavement, the first slurry material may be a primer coating, a micro-surfacing material, or an emulsion oil.

The first slurry material is dispersed 804 on the pavement surface to facilitate crack filling (or crack sealing) by urging the material into voids, or cracks, in the pavement surface. Dispersing 804 the first slurry material on the pavement surface also facilitates uniform spreading of the first slurry material to allow a layering effect with subsequently applied materials. In one embodiment, the first slurry material is dispersed 804 by a brush, a blade, or other suitable device. In other embodiments, the first slurry material is dispersed 804 using a material dispersal device such as device 100 shown in FIG. 1.

A second slurry material is applied 806 to the pavement surface using an auger, plumbing, or other means. In one embodiment, the second slurry material includes emulsified oil and aggregate. The second slurry material may also include one or more of emulsified asphalt, water, catalysts (e.g., Portland cement), chemicals to slow system break, fiber material, and other materials. In some embodiments, the second slurry material is an emulsion oil and is used to facilitate a crack sealing process. In some embodiments, the first slurry material and the second slurry material are different materials. In other embodiments, the first slurry material and the second slurry material are the same material. In one embodiment, the second slurry material is applied 806 then dispersed on the pavement surface by a brush, a blade, or other suitable device.

The first slurry material, second slurry material, and pavement surface may be covered 808 by an aggregate. In one embodiment, the aggregate at least partially combines with material applied to the pavement surface. For example, the aggregate may at least partially settle, draw, or be urged into the first slurry material, the second slurry material, or both the first and second slurry materials on the pavement surface. The aggregate used to cover 808 the materials and pavement surface is chosen according to the application or desired characteristics of the final re-surfaced pavement. In some embodiments, the aggregate is a single aggregate. In other embodiments, the aggregate is a composition including one or more different aggregates, where each of the different aggregates has unique size, shape, texture, or other characteristics.

The method and systems described herein facilitate re-surfacing a pavement surface. Specifically, the method and systems for re-surfacing as described above facilitate applying a uniform layer of slurry material to a pavement surface using a material dispersal device configured to follow the contour of the pavement surface. In some embodiments, the re-surfacing material is a micro-surfacing material.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A system for re-surfacing a pavement surface, said system comprising:

a material dispersal device comprising:

a plurality of independent dispersing elements;

a plurality of biasing elements; and a plurality of independent dispersing assemblies, wherein each independent dispersing assembly of said plurality of independent dispersing assemblies comprises at least one biasing element of said plurality of biasing elements coupled to at least one independent dispersing element of said plurality of independent dispersing elements;

a first delivery mechanism coupled to said material dispersal device; and a first dispensing bar positioned between said material dispersal device and said first delivery mechanism.

2. The system for re-surfacing in accordance with claim 1 wherein each independent dispersing element of said plurality of independent dispersing elements is one of a brush and a blade.

3. The system for re-surfacing in accordance with claim 1 wherein said material dispersal device further comprises a frame, a first support member adjustably coupled to said frame, and a primary dispersing device comprising at least one independent dispersing assembly of said plurality of independent dispersing assemblies coupled to said first support member.

4. The system for re-surfacing in accordance with claim 3 wherein said primary dispersing device is configured to apply substantially uniform pressure across the pavement surface.

5. The system for re-surfacing in accordance with claim 3 wherein said material dispersal device further comprises a second support member adjustably coupled to said frame and a secondary dispersing device comprising at least one independent dispersing assembly of said plurality of independent dispersing assemblies coupled to said second support member.

6. The system for re-surfacing in accordance with claim 5 wherein said at least one independent dispersing assembly of said primary dispersing device is offset with respect to said at least one independent dispersing assembly of said secondary dispersing device.

7. The system for re-surfacing in accordance with claim 5 wherein said secondary dispersing device is configured to apply substantially uniform pressure across the pavement surface.

8. The system for re-surfacing in accordance with claim 1 wherein said first delivery mechanism is configured to apply a first spreadable material to the pavement surface and wherein said first dispersing bar is configured to disperse the first spreadable material on the pavement surface.

9. The system for re-surfacing in accordance with claim 1 further comprising a finishing bar extending from said material dispersal device.

10. The system for re-surfacing in accordance with claim 8 further comprising a first thermal biasing element located proximate said first dispersing bar, wherein said first thermal biasing element is configured to apply a thermal bias to the first spreadable material.

11. The system for re-surfacing in accordance with claim 8 wherein the first spreadable material comprises at least one of an emulsion oil, a slurry material, and an aggregate.

12. The system for re-surfacing in accordance with claim 8 further comprising a second delivery mechanism configured to apply a second spreadable material to the pavement surface.

13. The system for re-surfacing in accordance with claim 12 wherein the second spreadable material comprises at least one of an emulsion oil, a slurry material, and an aggregate.

14. The system for re-surfacing in accordance with claim 12 wherein the first spreadable material and the second spreadable material are different.

15. The system for re-surfacing in accordance with claim 12 further comprising a second dispersing bar configured to disperse the second spreadable material on the pavement surface.

16. The system for re-surfacing in accordance with claim 15 wherein said second delivery mechanism is located between said material dispersal device and said second dispersing bar.

17. The system for re-surfacing in accordance with claim 15 further comprising a second thermal biasing element located proximate said second dispersing bar, wherein said second thermal biasing element is configured to apply a second thermal bias to the second spreadable material.

18. A system for re-surfacing a pavement surface, said system comprising:

a material dispersal device comprising:

a frame;

a first support member adjustably coupled to said frame;

a second support member adjustably coupled to said frame;

a plurality of independent dispersing elements;

a plurality of biasing elements;

a plurality of independent dispersing assemblies, wherein each independent dispersing assembly of said plurality of independent dispersing assemblies comprises at least one biasing element of said plurality of biasing elements coupled to at least one independent dispersing element of said plurality of independent dispersing elements;

a primary dispersing device comprising at least one independent dispersing assembly of said plurality of independent dispersing assemblies coupled to said first support member; and a secondary dispersing device comprising at least one independent dispersing assembly of said plurality of independent dispersing assemblies coupled to said second support member;

a delivery mechanism configured to apply a spreadable material to the pavement surface; and a dispersing bar configured to disperse the spreadable material on the pavement surface.

19. The system for re-surfacing in accordance with claim 18 wherein each independent dispersing element of said plurality of independent dispersing elements is one of a brush and a blade.

20. The system for re-surfacing in accordance with claim 18 wherein the spreadable material comprises at least one of an emulsion oil, a slurry material, and an aggregate.

21. The system for re-surfacing in accordance with claim 18 wherein said at least one independent dispersing assembly of said primary dispersing device is offset with respect to said at least one independent dispersing assembly of said secondary dispersing device.

22. The system for re-surfacing in accordance with claim 18 wherein said primary dispersing device and said secondary dispersing device are configured to apply substantially uniform pressure across the pavement surface.

23. The system for re-surfacing in accordance with claim 18 wherein said delivery mechanism is located between said material dispersal device and said dispersing bar.

24. The system for re-surfacing in accordance with claim 18 wherein said dispersing bar is located between said delivery mechanism and said material dispersal device.

25. The system for re-surfacing in accordance with claim 18 further comprising a thermal biasing element located proximate said dispersing bar, wherein said thermal biasing element is configured to apply a thermal bias to the spreadable material.

26. The system for re-surfacing in accordance with claim 18 further comprising a finishing bar extending from said material dispersal device.

27. A method for re-surfacing a pavement surface, said method comprising:

applying a first spreadable material to the pavement surface using a first delivery mechanism; and dispersing the first spreadable material on the pavement surface using a first dispersing bar configured to apply substantially uniform pressure across the pavement surface; and applying a second spreadable material to the first spreadable material on the pavement surface using a second delivery mechanism, and dispersing the second spreadable material using a second dispersing bar.

28. The method for re-surfacing in accordance with claim 27 wherein the first spreadable material comprises at least one of an emulsion oil, a slurry material, and an aggregate.

29. The method for re-surfacing in accordance with claim 27 further comprising applying a first thermal bias to the first spreadable material using a first thermal biasing element.

30. The method for re-surfacing in accordance with claim 27 further comprising applying a slurry material to the re-surfaced pavement surface using a material dispersal device, wherein the thickness of the slurry material is substantially uniform across the pavement surface.

31. The method for re-surfacing in accordance with claim 30 wherein the slurry material comprises at least one of an emulsion oil, a slurry material, and an aggregate.

32. The method for re-surfacing in accordance with claim 30 wherein the first spreadable material and the slurry material are different.

33. The method for re-surfacing in accordance with claim 27 wherein the second spreadable material comprises at least one of an emulsion oil, a slurry material, and an aggregate.

34. The method for re-surfacing in accordance with claim 27 further comprising applying a second thermal bias to the second spreadable material using a second thermal biasing element.

35. The method for re-surfacing in accordance with claim 27 further comprising covering the re-surfaced pavement surface with an aggregate.

36. The method for re-surfacing in accordance with claim 27 further comprising texturing the re-surfaced pavement surface using a finishing bar to create a surface texture.

37. The method for re-surfacing in accordance with claim 27 wherein the thickness of the re-surfacing material is less than about ⅜ inches.

38. The method for re-surfacing in accordance with claim 27 wherein dispersing the first spreadable material comprises using a plurality of independent dispersing assemblies, wherein each independent dispersing assembly of the plurality of independent dispersing assemblies comprises at least one biasing element coupled to at least one independent dispersing element.

* * * * *